US009699548B2

(12) United States Patent
Hou

(10) Patent No.: US 9,699,548 B2
(45) Date of Patent: Jul. 4, 2017

(54) MINIATURE LOUDSPEAKER MODULE, METHOD FOR ENHANCING FREQUENCY RESPONSE THEREOF, AND ELECTRONIC DEVICE

(71) Applicant: Goertek Inc., Weifang (CN)

(72) Inventor: Kang Hou, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 14/397,831

(22) PCT Filed: Jun. 5, 2014

(86) PCT No.: PCT/CN2014/079267

§ 371 (c)(1),
(2) Date: Oct. 29, 2014

(87) PCT Pub. No.: WO2015/074402

PCT Pub. Date: May 28, 2015

(65) Prior Publication Data

US 2016/0286305 A1 Sep. 29, 2016

(30) Foreign Application Priority Data

Nov. 19, 2013 (CN) ..... 2013 1 0583187

(51) Int. Cl.
*H04R 9/06* (2006.01)
*H04R 1/28* (2006.01)
(Continued)

(52) U.S. Cl.
CPC ..... *H04R 1/2834* (2013.01); *H04R 3/04* (2013.01); *H04R 3/08* (2013.01); *H04R 29/001* (2013.01);
(Continued)

(58) Field of Classification Search
CPC . H04R 1/227; H04R 1/24; H04R 1/26; H04R 1/345; H04R 1/28; H04R 1/2811;
(Continued)

(56) References Cited

U.S. PATENT DOCUMENTS

2001/0024508 A1* 9/2001 Croft, III ..... H04R 1/2842 381/345
2007/0172081 A1 7/2007 Oxford et al.
(Continued)

FOREIGN PATENT DOCUMENTS

CN 101052237 A 10/2007
CN 101765037 6/2010
(Continued)

OTHER PUBLICATIONS

Written Opinion cited by the Chinese Patent Office in International Patent Application No. PCT/CN2014/079267 (Aug. 5, 2014).
(Continued)

*Primary Examiner* — Leshui Zhang
(74) *Attorney, Agent, or Firm* — Michael Best & Friedrich LLP

(57) ABSTRACT

The present invention discloses a miniature loudspeaker module, a method for enhancing frequency response of a miniature loudspeaker module, and an electronic device. The method comprises the steps of: additionally providing a passive driver in a cavity where an active driver of a miniature loudspeaker module is located, the passive driver and the active driver radiating together, wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb; and, perform, according to amplitude characteristics of the
(Continued)

vibrating diaphragm of the active driver of the miniature loudspeaker module additionally provided with the passive driver, matching enhancement to an input signal of the active driver. In the technical solutions provided by the present invention, as the frequency response of the whole miniature loudspeaker module on low frequency bands below F0 is enhanced after a passive driver is additionally provided, and matching enhancement is further performed to signals according to the amplitude characteristics of the active driver, the frequency resource of the miniature loudspeaker module on the whole frequency band is enhanced greatly.

8 Claims, 6 Drawing Sheets

(51) Int. Cl.

| | |
|---|---|
| ***H04R 3/04*** | (2006.01) |
| ***H04R 3/08*** | (2006.01) |
| ***H04R 29/00*** | (2006.01) |
| *H04R 3/00* | (2006.01) |
| *H04R 3/12* | (2006.01) |

(52) U.S. Cl.
CPC ..... *H04R 1/2842* (2013.01); *H04R 3/007* (2013.01); *H04R 3/12* (2013.01); *H04R 2499/11* (2013.01)

(58) Field of Classification Search
CPC .. H04R 1/2819; H04R 1/2834; H04R 1/2826; H04R 1/2842; H04R 1/2849; H04R 25/00; H04R 31/00; H04R 3/00; H04R 3/002; H04R 3/08; H04R 3/04; H04R 3/14; H04R 29/001; H04R 2499/00; H04R 2499/01; H04R 2499/10; H04R 2499/11; H04R 2499/13; H04R 2499/15; H04R 2201/028
USPC ..... 381/335, 345, 347–349, 350–351, 120, 381/96–103, 86, 337–339, 332, 386, 336, 381/352, 341, 342, 303–305, 302, 87, 381/353–354; 181/182, 184, 189, 198, 181/156, 185, 186, 187, 196, 199, 148, 181/149, 153, 155, 160, 144–145; 330/10, 251; 367/157; 700/94
See application file for complete search history.

(56) References Cited

U.S. PATENT DOCUMENTS

| | | | | |
|---|---|---|---|---|
| 2009/0316933 | A1* | 12/2009 | Koyama | H03F 3/183 381/107 |
| 2011/0228945 | A1* | 9/2011 | Mihelich | H04R 3/002 381/59 |

FOREIGN PATENT DOCUMENTS

| | | | |
|---|---|---|---|
| CN | 101778321 | A | 7/2010 |
| CN | 103686555 | A | 3/2014 |
| CN | 103686556 | A | 3/2014 |

OTHER PUBLICATIONS

International Search Report cited by the Chinese Patent Office in International Patent Application No. PCT/CN2014/079267 (Aug. 5, 2014).

* cited by examiner

MINIATURE LOUDSPEAKER MODULE, METHOD FOR ENHANCING FREQUENCY RESPONSE THEREOF, AND ELECTRONIC DEVICE

TECHNICAL FIELD

The present invention relates to the field of acoustic technology, and particularly to a miniature loudspeaker module, a method for enhancing frequency response thereof, and an electronic device.

BACKGROUND ART

At present, in the communication acoustic field and electronic devices such as mobile terminals (for example, mobile phones, PADs, notebook computers, etc.), the majority of miniature moving coil type loudspeaker modules employ a closed rear cavity design where an acoustic drive assembly is enclosed by a housing, and the rear cavity of the whole loudspeaker module is closed. Due to the limitations of the size of the rear cavity and the volume of a product, a miniature loudspeaker module has a high low-frequency resonance point F0 and thus cannot provide low enough low-frequency descending. Related equalizer (EQ) and bass enhancement algorithms are both designed on the basis of such closed-case type miniature loudspeaker modules. However, on frequency bands below F0, due to the limitations of the vibration amplitude of the existing vibrating diaphragms and the size of elements, the real low-frequency descending cannot be realized in physical significance.

SUMMARY OF THE INVENTION

The present invention provides a miniature loudspeaker module, a method for enhancing frequency response of a miniature loudspeaker module, and an electronic device, in order to solve the problem that an existing miniature loudspeaker module cannot provide enough low-frequency sound reproduction.

To achieve the above object, the technical solutions of the present invention are implemented in such a way:

The present invention discloses a method for enhancing frequency response of a miniature loudspeaker module, including the steps of:

additionally providing a passive driver in a cavity where an active driver of a miniature loudspeaker module is located, the passive driver and the active driver radiating together;

wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb; and performing, according to amplitude characteristics of the vibrating diaphragm of the active driver of the miniature loudspeaker module additionally provided with the passive driver, matching enhancement to an input signal of the active driver.

Optionally, the miniature loudspeaker module is of a front porting design, and the passive driver and the active driver radiate separately;

or, the miniature loudspeaker module is of a front porting design, and the passive driver and the active driver share a front cavity and radiate together;

or, the miniature loudspeaker module is of a side porting design, and the passive driver and the active driver share a front cavity.

Optionally, the performing, according to the amplitude characteristics of the vibrating diaphragm of the active driver of the miniature loudspeaker module additionally provided with the passive driver, matching enhancement to an input signal of the active driver includes:

filtering out signals below a first frequency point which is a frequency point below Fb, to filter out signals having an amplitude beyond an allowable range of the vibrating diaphragm of the active driver on frequency bands below Fb;

performing band-pass filtering and enhancement to signals within a certain frequency band taking Fb as a central frequency point, to realize low-frequency descending and bass enhancement;

performing notch filtering to signals within a certain frequency band taking F0 as a central frequency point, to avoid too large amplitude of the vibrating diaphragm of the active driver near F0; and performing high-pass filtering and enhancement to signals above a second frequency point higher than F0, and enhancing mid and high frequency response by using the characteristic of small amplitude of the vibrating diaphragm of the active driver on mid and high frequency bands.

Optionally, the method further includes the steps of:

adjusting Fb by changing the coefficient of stiffness of the passive driver; and/or, adjusting F0 by changing the property of the vibrating diaphragm and the quality of voice coil of the active driver; and adjusting, according to the values of Fb and F0 and the characteristics of both a power amplifier and the amplitude of the vibrating diaphragm, one or more of the following parameters of a filter during the matching enhancement: Q value, order, frequency band attenuation parameter and cutoff frequency.

The present invention further discloses a miniature loudspeaker module, including a cavity and an active driver disposed in the cavity, wherein the miniature loudspeaker module further includes a passive driver and a matching enhancement unit;

the passive driver is disposed in the cavity where the active driver is located, and the passive driver and the active driver radiate together;

wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb; and the matching enhancement unit is configured to perform, according to amplitude characteristics of the vibrating diaphragm of the active driver of the miniature loudspeaker module additionally provided with the passive driver, matching enhancement to an input signal of the active driver.

Optionally, the miniature loudspeaker module is of a front porting design, and the passive driver and the active driver radiate separately;

or, the miniature loudspeaker module is of a front porting design, and the passive driver and the active driver share a front cavity and radiate together;

or, the miniature loudspeaker module is of a side porting design, and the passive driver and the active driver share a front cavity.

Optionally, the matching enhancement unit includes:

a very-low-frequency filter unit, configured to filter out signals below a first frequency point which is a frequency point below Fb, to filter out signals having an amplitude beyond an allowable range of the vibrating diaphragm of the active driver on frequency bands below Fb;

a low-frequency enhancement unit, configured to perform band-pass filtering and enhancement to signals within a certain frequency band taking Fb as a central frequency point, to realize low-frequency descending and bass enhancement;

a low-frequency reduction unit, configured to perform notch filtering to signals within a certain frequency band taking F0 as a central frequency point, to avoid too large amplitude of the vibrating diaphragm of the active driver near F0; and a high-frequency enhancement unit, configured to perform high-pass filtering and enhancement to signals above a second frequency point higher than F0, and enhance mid and high frequency response by using the characteristic of small amplitude of the vibrating diaphragm of the active driver on mid and high frequency bands.

Optionally,

Fb is adjusted by changing the coefficient of stiffness of the passive driver; and/or, F0 is adjusted by changing the property of the vibrating diaphragm and the quality of voice coil of the active driver; and according to the values of Fb and F0 and the characteristics of both a power amplifier and the amplitude of the vibrating diaphragm, one or more of the following parameters of a filter is adjusted during the matching enhancement: Q value, order, frequency band attenuation parameter and cutoff frequency.

The present invention further discloses an electronic device, including the miniature loudspeaker module according to any one of the above items.

Optionally, the electronic device is a mobile phone, a tablet computer, a tablet television set or a notebook computer.

In the present invention, by the technical solutions of additionally providing a passive driver in a cavity where an active driver of a miniature loudspeaker module is located, the passive driver and the active driver radiating together, wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb; and performing, according to amplitude characteristics of the vibrating diaphragm of the active driver of the miniature loudspeaker module additionally provided with the passive driver, matching enhancement to an input signal of the active driver, as the frequency response of the whole miniature loudspeaker module on low frequency bands below F0 is enhanced after a passive driver is additionally provided, and matching enhancement is further performed to signals according to the amplitude characteristics of the active driver, the frequency response of the miniature loudspeaker module on the whole frequency band is enhanced greatly.

DETAILED DESCRIPTION OF THE INVENTION

In order to make the objects, technical solutions and advantages of the present invention clearer, embodiments of the present invention will be further described as below in details with reference to the accompanying drawings.

Figure 1:
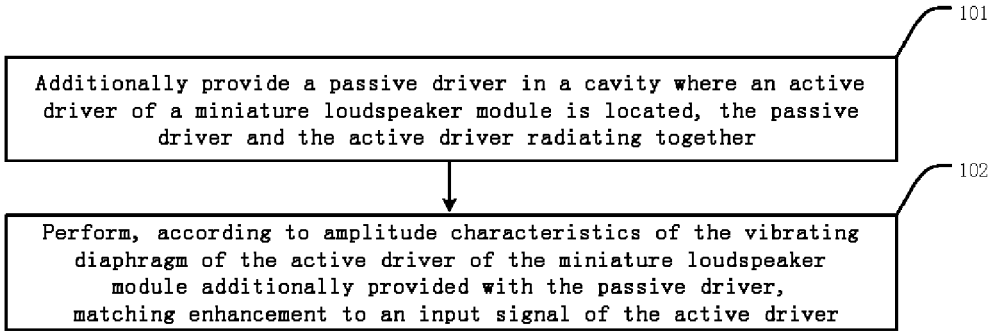
FIG. 1 is a flowchart of a method for enhancing frequency response of a miniature loudspeaker module according to an embodiment of the present invention.

FIG. 1 is a flowchart of a method for enhancing frequency response of a miniature loudspeaker module according to an embodiment of the present invention. As shown in FIG. 1, the method includes the following steps:

S101: A passive driver is additionally provided in a cavity where an active driver of a miniature loudspeaker is located, and the passive driver and the active driver radiate together.

Here, the passive driver is additionally provided in the cavity where the active driver of the miniature loudspeaker is located, so that a vibrating diaphragm of the active driver squeezes air in the cavity when the active driver works, the air in the cavity pushes a vibrating diaphragm of the passive driver to generate a second driver signal, and the second driver signal and an active driver signal radiate together so as to enhance the low frequency response of the loudspeaker.

Wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb.

S102: Matching enhancement is performed to an input signal of the active driver according to amplitude characteristics of the vibrating diaphragm of the active driver of the miniature loudspeaker module additionally provided with the passive driver.

In the loudspeaker module designed with a passive driver in the method as shown in FIG. 1, as the frequency response of the miniature loudspeaker module on low frequency bands below F0 is enhanced after a passive driver is additionally provided, and matching enhancement is further performed so that the frequency response of the miniature loudspeaker module on the whole frequency band is enhanced greatly. By the method as shown in FIG. 1, the low frequency response of the miniature loudspeaker module is effectively enhanced, and enough low-frequency descending and loudness are provided, so the method may be widely applied in the micro-electroacoustic field, for example, mobile phones, tablet computers, television sets, notebook computers, etc.

Figure 2:
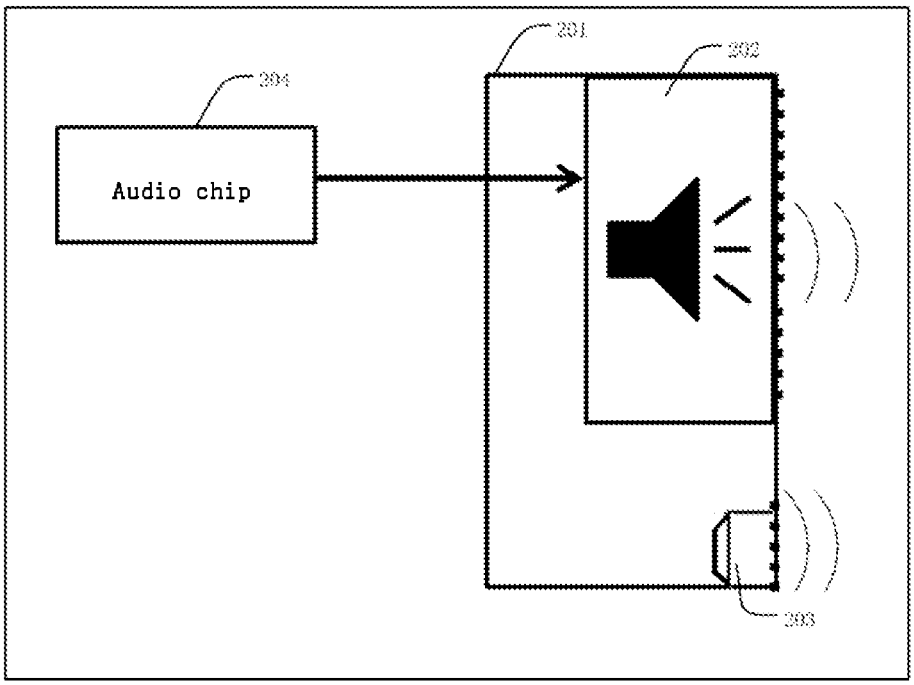
FIG. 2 is a schematic diagram of a miniature loudspeaker module having a passive driver structure according to an embodiment of the present invention.

FIG. 2 is a schematic diagram of a miniature loudspeaker module having a passive driver structure according to an embodiment of the present invention. Referring to FIG. 2, in one embodiment of the present invention, by the method shown in FIG. 1, a passive driver 203 is additionally provided in a cavity 201 where an active driver 202 of the miniature loudspeaker module is located. In this embodiment, the miniature loudspeaker module is of a front porting design, and the passive driver 203 and the active driver 202 radiate separately. Specifically, the passive driver 203 is provided at a position having a preset distance away from the active driver 202 in the cavity 201, the passive driver 203 has a same porting direction as the active driver 202, and a sound outlet 205 and a sound outlet 206 are provided at positions directly facing the passive driver 203 and the active driver 202 in the cavity 201, respectively. An audio chip 204 for realizing enhancement performs matching enhancement to a signal input into the active driver 202.

Figure 3:
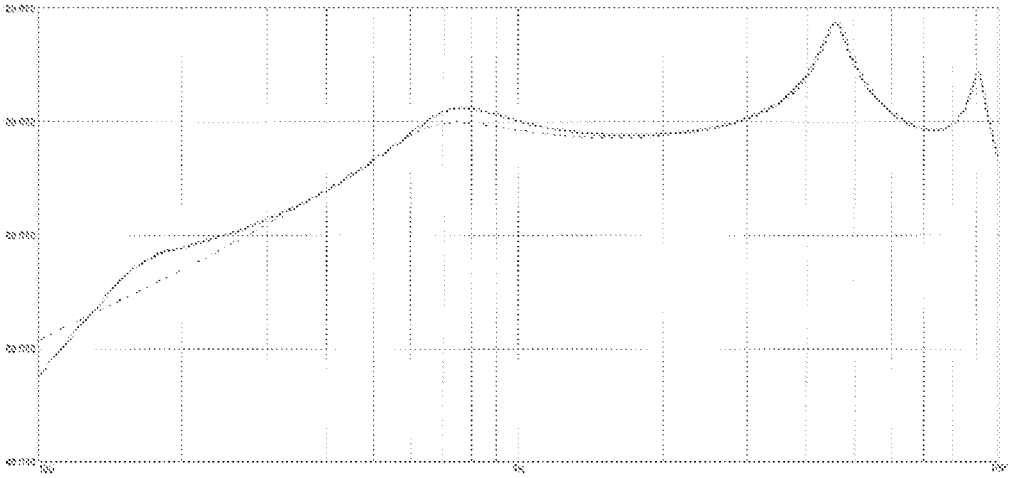
FIG. 3 is a comparison diagram of frequency response curves of a miniature loudspeaker module having a passive driver structure and a miniature loudspeaker module of a conventional closed-case design according to an embodiment of the present invention.

FIG. 3 is a comparison diagram of frequency response curves of a miniature loudspeaker module having a passive driver structure and a miniature loudspeaker module of a conventional closed-case design according to an embodiment of the present invention. FIG. 3 shows a comparison diagram of typical frequency response curves of a miniature loudspeaker module having a passive driver structure designed with reference to FIG. 1 and a miniature loudspeaker module of a conventional closed-case design, wherein the solid line represents a frequency response curve of the miniature loudspeaker module having a passive driver structure, and the dashed line represents a frequency response curve of the miniature loudspeaker module of the conventional closed-case design. Referring to FIG. 3, without performing matching enhancement, the low frequency sensitivity of the miniature loudspeaker module having a passive driver structure is enhanced to a certain extent in comparison to the miniature loudspeaker module of the conventional closed-case design.

Figure 4:
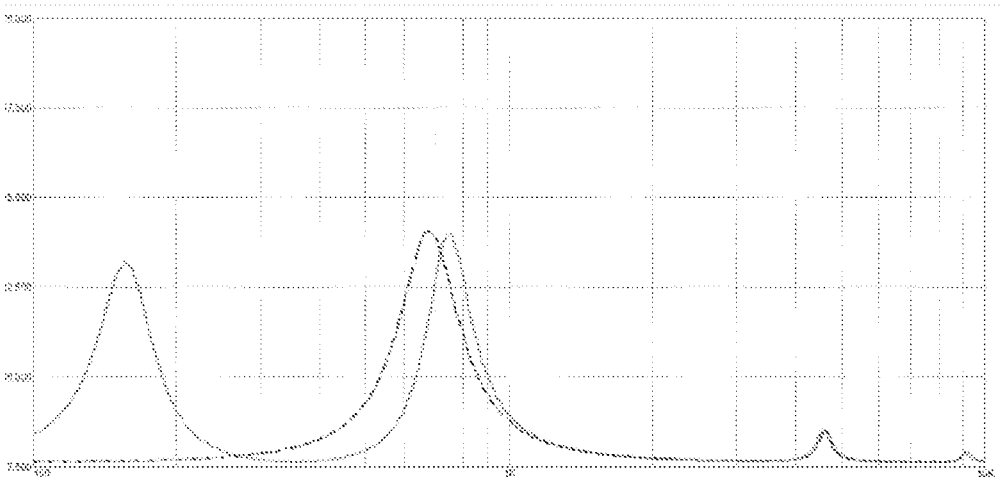
FIG. 4 is a comparison diagram of impedance curves of a miniature loudspeaker module having a passive driver structure and a miniature loudspeaker module of a conventional closed-case design according to an embodiment of the present invention.

FIG. 4 is a comparison diagram of impedance curves of a miniature loudspeaker module having a passive driver structure and a miniature loudspeaker module of a conventional closed-case design according to an embodiment of the present invention. In FIG. 4, the solid line represents an impedance curve of the miniature loudspeaker module having a passive driver structure, and the dashed line represents an impedance curve of the miniature loudspeaker module of the conventional closed-case design. It can be seen from FIG. 4 that the miniature loudspeaker module having a passive driver structure shows a local low point (around 350 Hz in this embodiment, the frequency point at 350 Hz is called Fb) on the impedance curve because the radiation of the passive driver on low frequency bands and the vibration amplitude of the voice coil are limited.

Figure 5:
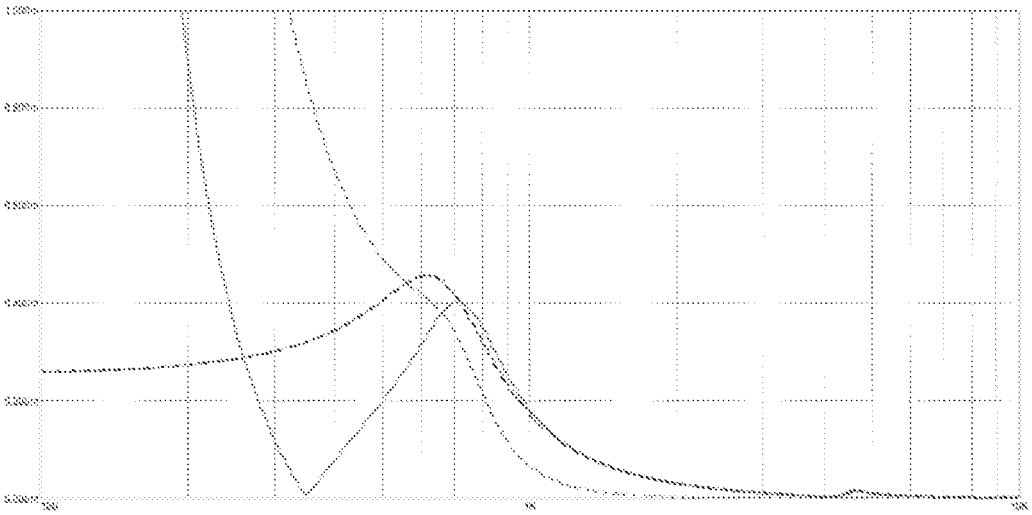
FIG. 5 is a comparison diagram of vibration amplitude curves of a miniature loudspeaker module having a passive driver structure and a miniature loudspeaker module of a conventional closed-case design according to an embodiment of the present invention.

FIG. 5 is a comparison diagram of vibration amplitude curves of a miniature loudspeaker module having a passive driver structure and a miniature loudspeaker module of a conventional closed-case design according to an embodiment of the present invention. Referring to FIG. 5, the dotted line represents a vibration amplitude curve of the miniature loudspeaker module of the conventional closed-case, the solid line represents a vibration amplitude curve of an active driver in the miniature loudspeaker module having a passive driver structure, and the dashed line represents a vibration amplitude curve of the passive driver in the miniature loudspeaker module having a passive driver structure. It can be seen from FIG. 5 that the vibration amplitude of the active driver represented by the solid line shows a local lowest point Fb on frequency bands below a resonance point F0 (in this embodiment, F0 is a frequency point near 700 Hz, and Fb is a frequency point at 350 Hz). That is, Fb is a frequency point corresponding to a lowest amplitude point, below the resonance point F0, on the amplitude of the active driver of the miniature loudspeaker module additionally provided with the passive driver.

Figure 6:
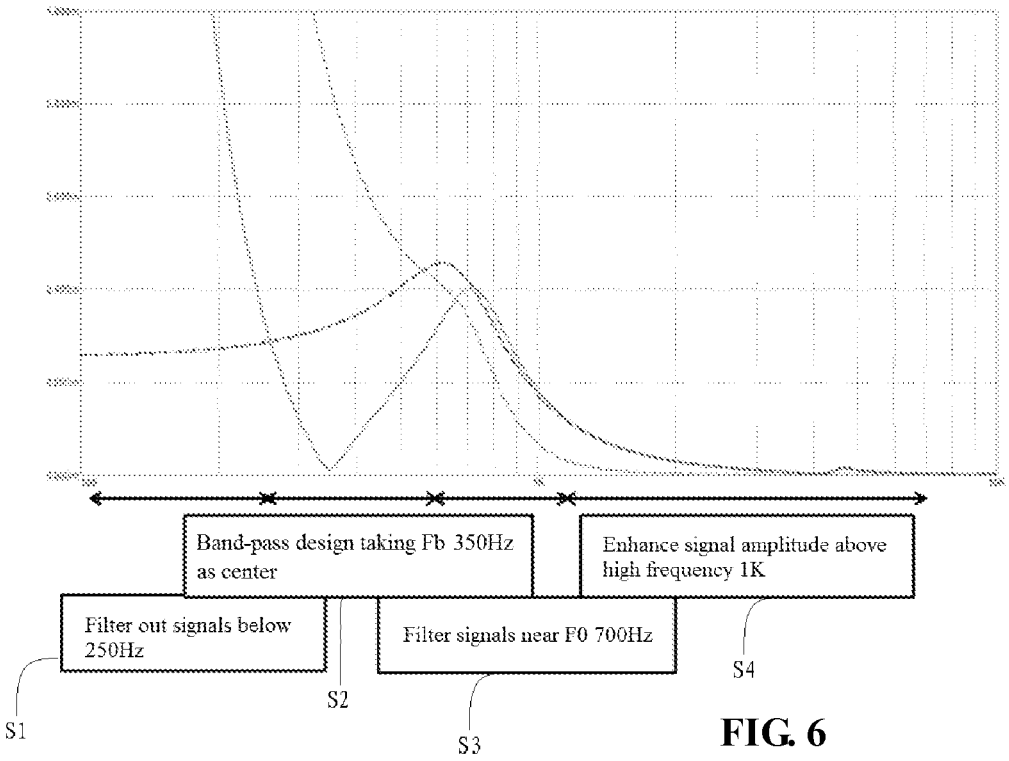
FIG. 6 is a schematic diagram of a matching enhancement algorithm designed with respect to the amplitude characteristics as shown in FIG. 5 of the miniature loudspeaker module having a passive driver structure according to an embodiment of the present invention.

With respect to the characteristics as shown in FIG. 5, a matching enhancement algorithm as shown in FIG. 6 is designed in the embodiment of the present invention.

FIG. 6 is a schematic diagram of a matching enhancement algorithm designed with respect to the amplitude characteristic as shown in FIG. 5 of the miniature loudspeaker module having a passive driver structure according to an embodiment of the present invention. Referring to FIG. 6, the matching enhancement algorithm is specifically:

S1: Signals below a first frequency point which is a frequency point below Fb are filtered out, to filter out signals having an amplitude beyond an allowable range of the vibrating diaphragm of the active driver on frequency bands below Fb (in this embodiment, signals below 250 Hz are filtered out).

Here, the signals below the first frequency point are called very-low-frequency signals. The vibration amplitude of the vibrating diaphragm is large in this frequency band and is beyond an allowable range of the vibrating diaphragm of the active driver (approximate to/reach/beyond the amplitude allowed by a vibrating diaphragm). Filtering very-low-frequency signals is generally implemented by a high-pass filter, and the filter cutoff frequency is determined by the vibration amplitude curve of the vibrating diaphragm of the active driver and the property of the vibrating diaphragm itself. For example, the filter cutoff frequency is taken as the first frequency point, which can be selected as a frequency point below Fb, and at the first frequency point and the filter cutoff frequency the vibration amplitude curve of the active driver of the miniature loudspeaker module having a passive driver structure reaches an amplitude allowed by the vibrating diaphragm.

S2: Band-pass filtering and enhancement are performed to signals within a certain frequency band taking Fb as a central frequency point, to realize low-frequency descending and bass enhancement.

Here, by making full use of the characteristics of the dip of the vibration amplitude of the vibrating diaphragm within the Fb region, the signals on this frequency band are enhanced, thereby realizing low-frequency descending and bass enhancement; wherein, Fb is a frequency point corresponding to a lowest amplitude point, below the low frequency F0, on the vibration amplitude curve of the active driver of the miniature loudspeaker module additionally provided with the passive driver (in this embodiment, Fb is at 350 Hz). The above certain frequency band taking Fb as a central frequency point can be defined by a preset threshold and the vibration amplitude curve of the active driver of the miniature loudspeaker module having a passive driver structure. For example, two frequency points allowing the vibration amplitude curve of the active driver of the miniature loudspeaker module having a passive driver structure to reach a preset threshold (the threshold is set as required, for example, the threshold can be 60% or 70% of the amplitude allowed by a vibrating diaphragm) may be selected as two endpoints of the frequency band.

S3: Notch filtering is performed to signals within a certain frequency band taking F0 as a central frequency point, to avoid too large amplitude of the vibrating diaphragm of the active driver near F0.

Because the processing is not suitable for excessive enhancement if the vibration amplitude of the vibrating diaphragm near F0 is larger, notch filtering is performed here to avoid too large amplitude, wherein F0 is a low frequency resonance point of the miniature loudspeaker module additionally provided with the passive driver (in this embodiment, F0 is at 700 Hz). The above certain frequency band taking F0 as a central frequency point can be defined by a preset threshold and the vibration amplitude curve of the active driver of the miniature loudspeaker module having a passive driver structure. For example, two frequency points allowing the vibration amplitude curve of the active driver of the miniature loudspeaker module having a passive driver structure to reach a preset threshold (the threshold is set as required, for example, the threshold can be 40% or 60% of the amplitude allowed by a vibrating diaphragm) may be selected as two endpoints of the frequency band.

S4: High-pass filtering and enhancement are performed to signals above a second frequency point higher than F0, to enhance mid and high frequency response by using the characteristic of small amplitude of the vibrating diaphragm of the active driver on mid and high frequency bands. The second frequency point is a frequency point higher than F0. It can be seen from the amplitude characteristic that, under frequency higher than F0, the amplitude of the vibrating diaphragm decreases with the increase of the frequency. Therefore, the second frequency point higher than F0 may be selected, wherein an amplitude of the vibrating diaphragm corresponding to the frequency above the second frequency point is less than a preset threshold (the threshold can be set as required, for example, the threshold may be 20% or 30% or 40% of an amplitude allowed by the vibrating diaphragm). By performing high-pass filtering and enhancement to the signals having frequency higher than the second frequency point, mid and high frequency response may be enhanced.

As the amplitude of the vibrating diaphragm on high frequency bands is small, the frequency response of the whole system shall be greatly enhanced by performing enhancement to high frequency signals.

Figure 7:
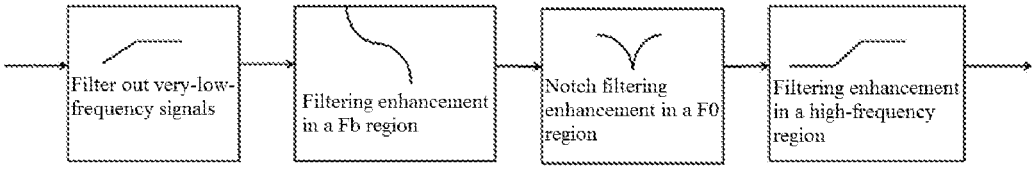
FIG. 7 is a schematic diagram of a matching enhancement algorithm designed based on FIG. 6 with respect to the miniature loudspeaker module having a passive driver structure according to an embodiment of the present invention.

FIG. 7 is a schematic diagram of a matching enhancement algorithm designed based on FIG. 6 with respect to the miniature loudspeaker module having a passive driver structure according to an embodiment of the present invention. Referring to FIG. 7, signals input into the active driver of the miniature loudspeaker module having a passive driver structure in the present invention are performed the following processing in turn: filtering out very-low-frequency signals, performing enhanced filtering to frequency bands near Fb, performing notch filtering to frequency bands near F0, and performing enhanced filtering in a high frequency region. It is to be noted that steps in 4 blocks in FIG. 7 are not limited to the order shown in FIG. 7 currently, and the steps in the 4 blocks may be performed in any order in other embodiments of the present invention.

Fb is adjusted by changing the coefficient of stiffness of the passive driver; F0 is adjusted by changing the property of the vibrating diaphragm and the quality of voice coil of the active driver. And, according to the values of Fb and F0 and the characteristics of both a power amplifier and the amplitude of the vibrating diaphragm, one or more of the following parameters of a filter is adjusted during the matching enhancement: Q value, order, frequency band attenuation parameter and cutoff frequency.

There are various implementation ways of matching enhancement and filter amplification in the present invention. The matching enhancement and filter amplification may be implemented by software or hardware or may be implemented by analog or digital signals. But the core framework of implementation should conform to FIG. 6 and FIG. 7, particularly bass enhancement taking Fb as center.

Figure 8:
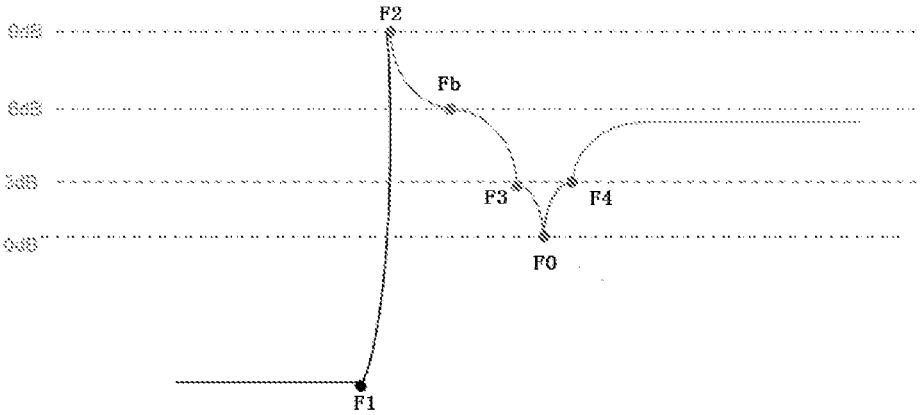
FIG. 8 is a schematic diagram of specific processing, on different frequency bands, of the matching enhancement algorithm designed based on FIG. 6 and FIG. 7 with respect to the miniature loudspeaker module having a passive driver structure according to an embodiment of the present invention.

FIG. 8 is a schematic diagram of specific processing, on different frequency bands, of the matching enhancement algorithm designed based on FIG. 6 and FIG. 7 with respect to the miniature loudspeaker module having a passive driver structure according to an embodiment of the present invention. Referring to FIG. 8, in this embodiment, the matching enhancement algorithm is specifically:

filtering out signals below a frequency point F1, to filter out signals having an amplitude beyond an allowable range of the vibrating diaphragm of the active driver on frequency bands below Fb, wherein the frequency point F1 is a frequency point allowing the amplitude curve of the active driver of the miniature loudspeaker module having a passive driver structure to reach an amplitude allowed by the vibrating diaphragm;

performing band-pass filtering and enhancement to signals within a certain frequency band taking Fb as a central frequency point, the signals within a certain frequency band being signals with a frequency band range from F2 to F3, wherein frequency points F2 and F3 are two frequency points allowing the amplitude curve of the active driver of the miniature loudspeaker module having a passive driver structure to reach a preset threshold, respectively;

performing notch filtering to signals within a certain frequency band taking F0 as a central frequency point, the signals within a certain frequency band being signals with a frequency band range from F3 to F4, wherein frequency points F3 and F4 are two frequency points allowing the amplitude curve of the active driver of the miniature loudspeaker module having a passive driver structure to reach a preset threshold, respectively; and performing high-pass filtering and enhancement to signals having frequency above the frequency point F4, wherein the amplitude of the vibrating diaphragm corresponding to the frequency above the frequency point F4 is less than a preset threshold;

wherein, $F1<F2<Fb<F3<F0<F4$; and specific values of the Fb, F0, F1, F2, F3 and F4 are all defined according to specific parameters of the miniature loudspeaker module having a passive driver design.

For example, Fb is adjusted by the coefficient of stiffness of the passive driver, F0 is adjusted by changing the property of the vibrating diaphragm and the quality of voice coil of the active driver, and the Q value, order, frequency band attenuation, cutoff frequency and other parameters of a filter may be determined according to actual needs and the known parameters (the performance of an amplifier, the vibrating diaphragm of a loudspeaker, the property of voice coil, etc.) of the miniature loudspeaker module by a person skilled in the art; meanwhile, upper limits of algorithm complementation are adjusted by taking electrical and mechanical performances of the system into consideration, to avoid the damage to an active device resulted from excessive drive, which will not be repeated here.

Figure 9:
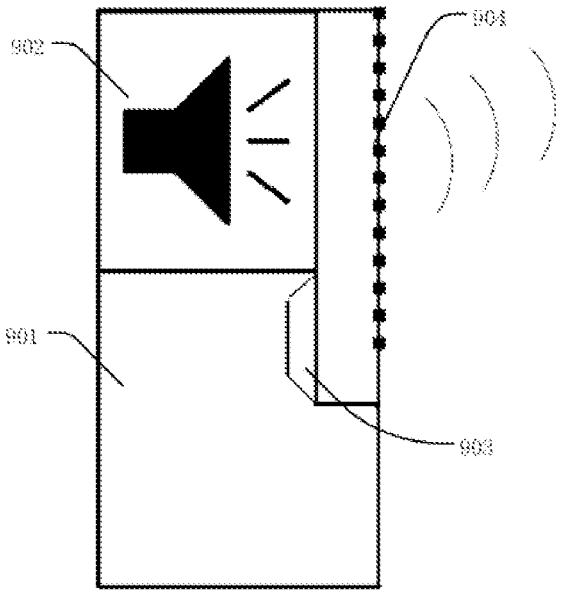
FIG. 9 is a schematic diagram of a miniature loudspeaker module having a passive driver structure according to another embodiment of the present invention.
Figure 10:
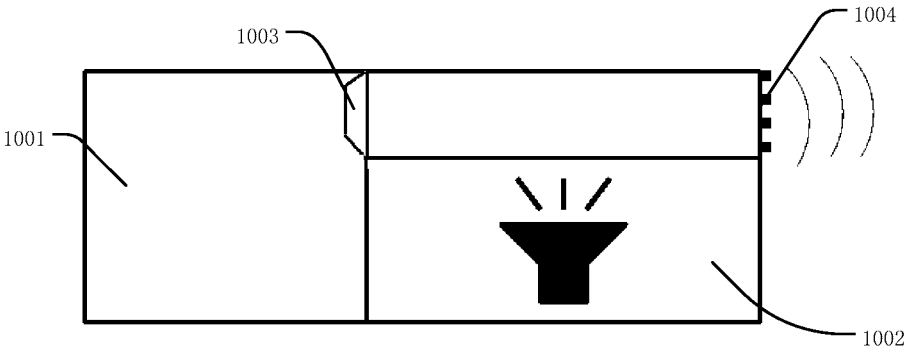
FIG. 10 is a schematic diagram of a miniature loudspeaker module having a passive driver structure according to another embodiment of the present invention.

The design of the miniature loudspeaker module having a passive driver structure provided by the present invention is not only limited to the structure shown in FIG. 2, and there are other various implementation ways in other embodiments of the present invention, as shown in FIG. 9 and FIG. 10.

FIG. 9 is a schematic diagram of a miniature loudspeaker module having a passive driver structure according to another embodiment of the present invention. Referring to FIG. 9, in this embodiment, the miniature loudspeaker module is of a front porting design, and a passive driver and an active driver share a front cavity and radiate together. Specifically, the passive driver 903 is provided at a position close to the active driver 902 in the cavity 901 of the miniature loudspeaker module, the passive driver 903 has the same porting direction as the active driver 902, and a common sound outlet 904 is provided at a position directly facing the passive driver 903 and the active driver 902 in the cavity 901.

FIG. 10 is a schematic diagram of a miniature loudspeaker module having a passive driver structure according to another embodiment of the present invention. Referring to FIG. 10, in this embodiment, the miniature loudspeaker module is of a side porting design, and a passive driver and an active driver share a front cavity. Specifically, the passive driver 1003 is provided at a position close to the active driver 1002 in the cavity 1001 of the miniature loudspeaker module, the porting directions of the passive driver 1003 and the active driver 1002 are vertically crossed, a sound outlet 1004 is provided at a position directly facing the passive driver 1003 in the cavity 1001, while there is no sound outlet provided at a position directly facing the active driver 1002.

In FIG. 9, a front porting design is shown, and the passive driver is adjacent to the active driver, so it is advantageous for the high frequency acoustic response of the system. In FIG. 10, a side porting design is shown, and the passive driver and the active driver share a front cavity, so the structure is more compact, and it is advantageous for lightening and thinning the system. In other embodiments of the present invention, the position of the passive driver may also be flexibly selected according to an actual system.

It is to be noted that, in FIG. 2, FIG. 9 and FIG. 10, the frame outside the active driver (i.e., the frame outside a trumpet-shaped icon) refers to the position of the active driver, but cannot be interpreted as an enclosed frame provided outside the active driver or other interpretations.

Figure 11:
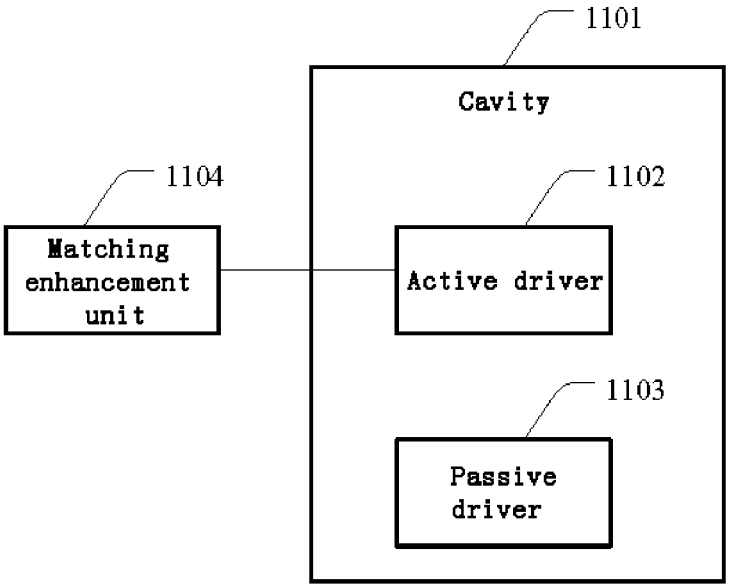
FIG. 11 is a structure diagram of a miniature loudspeaker module according to another embodiment of the present invention.

FIG. 11 is a structure diagram of a miniature loudspeaker module according to another embodiment of the present invention. As shown in FIG. 11, the miniature loudspeaker module includes a cavity 1101 and an active driver 1102 disposed in the cavity. The miniature loudspeaker module further includes a passive driver 1103 and a matching enhancement unit 1104.

The passive driver 1103 is disposed in the cavity 1101 where the active driver 1102 is located, and the passive driver 1103 and the active driver 1102 radiate together. When the active driver 1102 works, a vibrating diaphragm of the active driver 1102 squeezes air in the cavity 1101, and the air in the cavity 1101 pushes a vibrating diaphragm of the passive driver to generate a second driver signal such that the second driver signal and an active driver signal radiate together so as to enhance the low frequency response of the loudspeaker. Wherein, after the passive driver 1103 is additionally provided in the miniature loudspeaker module, the amplitude of the vibrating diaphragm of the active driver 1102 shows a local dip on frequency bands below a resonant frequency point F0, and the lowest point of the local dip is corresponding to a frequency point Fb.

The matching enhancement unit 1104 performs, according to amplitude characteristics of the vibrating diaphragm of the active driver of the miniature loudspeaker module additionally provided with the passive driver, matching enhancement to an input signal of the active driver.

In an embodiment of the present invention, the miniature loudspeaker module is of a front porting design, and the passive driver and the active driver radiate separately, specifically referring to FIG. 2.

In an embodiment of the present invention, the miniature loudspeaker module is of a front porting design, and the passive driver and the active driver share a front cavity and radiate together, specifically referring to FIG. 9.

In an embodiment of the present invention, the miniature loudspeaker module is of a side porting design, and the passive driver and the active driver share a front cavity, specifically referring to FIG. 10.

Figure 12:
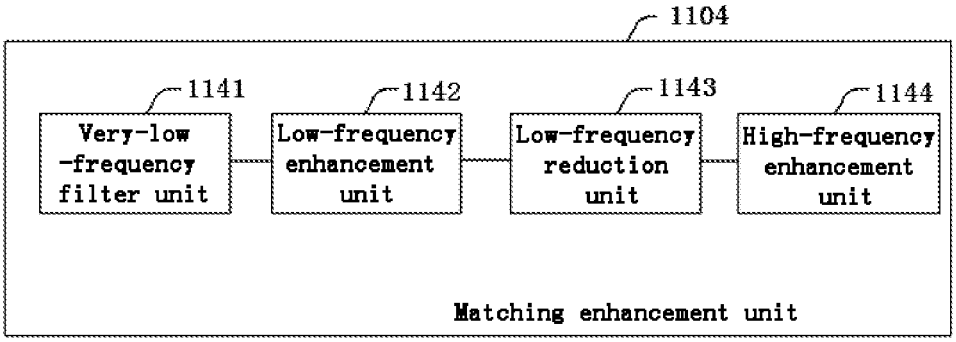
FIG. 12 is a structure diagram of a matching enhancement unit 1104 of FIG. 11.

FIG. 12 is a structure diagram of a matching enhancement unit 1104 in FIG. 11. Referring to FIG. 12, the matching enhancement unit 1104 includes a very-low-frequency filter unit 1141, a low-frequency enhancement unit 1142, a low-frequency reduction unit 1143 and a high-frequency enhancement unit 1144.

The very-low-frequency filter unit 1141 is configured to filter out signals below a first frequency point which is a frequency point below Fb, to filter out signals having an amplitude beyond an allowable range of the vibrating diaphragm of the active driver on frequency bands below Fb;

the low-frequency enhancement unit 1142 is configured to perform band-pass filtering and enhancement to signals within a certain frequency band taking Fb as a central frequency point, to realize low-frequency descending and bass enhancement;

the low-frequency reduction unit 1143 is configured to perform notch filtering to signals within a certain frequency band taking F0 as a central frequency point, to avoid too large amplitude of the vibrating diaphragm of the active driver near F0; and the high-frequency enhancement unit 1144 is configured to perform high-pass filtering and enhancement to signals above a second frequency point higher than F0, and enhance mid and high frequency response by using the characteristic of small amplitude of the vibrating diaphragm of the active driver on mid and high frequency bands.

It is to be noted that the above four units in the matching enhancement unit may be configured in any order, and the matching enhancement unit may be realized by software or hardware.

In an embodiment of the present invention, with respect to the miniature loudspeaker module shown in FIG. 11, Fb is adjusted by changing the coefficient of stiffness of the passive driver; and/or, F0 is adjusted by changing the property of the vibrating diaphragm and the quality of voice coil of the active driver; and, according to the values of Fb and F0 and the characteristics of both a power amplifier of the system and the amplitude of the vibrating diaphragm, one or more of the following parameters of a filter are adjusted during the matching enhancement: Q value, order, frequency band attenuation parameter and cutoff frequency.

An embodiment of the present invention further discloses an electronic device, including the miniature loudspeaker having a passive driver structure according to any one of the foregoing embodiments. The electronic device is a mobile phone, a tablet computer, a tablet television set or a notebook computer.

In conclusion, in the present invention, by the technical solutions of additionally providing a passive driver in a cavity where an active driver of a miniature loudspeaker module is located, the passive driver and the active driver radiating together, wherein, after the passive driver is additionally provided in the miniature loudspeaker module, the amplitude of a vibrating diaphragm of the active driver shows a local dip on frequency bands below a resonant frequency point F0, and the lowest point of the local dip is corresponding to a frequency point Fb; and performing, according to amplitude characteristics of the vibrating diaphragm of the active driver of the miniature loudspeaker module additionally provided with the passive driver, matching enhancement to an input signal of the active driver, as the frequency response of the whole miniature loudspeaker module on low frequency bands below F0 is enhanced after a passive driver is additionally provided, and matching enhancement is further performed, the frequency resource of the miniature loudspeaker module on the whole frequency band is enhanced greatly.

The foregoing descriptions merely show preferred embodiments of the present invention, and are not intended to limit the protection scope of the present invention. Any modification, equivalent replacement and improvement made within the spirit and principle of the present invention shall fall into the protection scope of the present invention.

The invention claimed is:

1. A method for enhancing frequency response of a miniature loudspeaker module, wherein the method comprises the steps of:

additionally providing a passive driver in a cavity where an active driver of the miniature loudspeaker module is located, the passive driver has a vibrating diaphragm, and the passive driver and the active driver radiating together;

wherein, after the passive driver is additionally provided in the miniature loudspeaker module, an amplitude characteristics of a vibrating diaphragm of the active driver shows a local dip frequency on frequency bands below a resonant frequency point F0 which is a low frequency resonance point of the miniature loudspeaker module additionally provided with the passive driver, and the lowest point of the local dip frequency is corresponding to a frequency point Fb; and performing, according to the amplitude characteristics of the vibrating diaphragm of the active driver of the miniature loudspeaker module additionally provided with the passive driver, matching enhancement to an input audio signal of the active driver;

wherein the performing, according to the amplitude characteristics of the vibrating diaphragm of the active driver of the miniature loudspeaker module additionally provided with the passive driver, matching enhancement to an input audio signal of the active driver comprises:

filtering out the input audio signal below a first frequency point which is a frequency point below the Fb, to filter out signals having an amplitude beyond an allowable range of the vibrating diaphragm of the active driver on frequency bands below the Fb;

performing band-pass filtering and enhancement to the input audio signal within a certain frequency band taking the Fb as a central frequency point, to realize low-frequency descending and bass enhancement;

performing notch filtering to the input audio signal within a certain frequency band taking the F0 as a central frequency point, to avoid too large amplitude of the vibrating diaphragm of the active driver near the F0; and performing high-pass filtering and enhancement to the input audio signal above a second frequency point higher than the F0, and enhancing mid and high frequency response by using the characteristic of small amplitude of the vibrating diaphragm of the active driver on mid and high frequency bands.

2. The method according to claim 1, wherein, the miniature loudspeaker module is of a front porting design, and the passive driver and the active driver share a front cavity, and sound outlets are provided at positions directly facing the passive driver and the active driver in the cavity;

or, the miniature loudspeaker module is of a front porting design, and the passive driver and the active driver share a front cavity, and a common sound outlet is provided at a position directly facing the passive driver and the active driver in the cavity;

or, the miniature loudspeaker module is of a side porting design, and the passive driver and the active driver share a front cavity.

3. The method according to claim 1, wherein the method further comprises the steps of:

adjusting the Fb by changing the coefficient of stiffness of the passive driver; and/or, adjusting the F0 by changing the property of the vibrating diaphragm and the quality of voice coil of the active driver; and adjusting, according to the values of the Fb and the F0 and the characteristics of both a power amplifier and the amplitude of the vibrating diaphragm, one or more of the following parameters of a filter during the matching enhancement: Q value, order, frequency band attenuation parameter and cutoff frequency.

4. A miniature loudspeaker module, comprising a cavity and an active driver disposed in the cavity, wherein the miniature loudspeaker module further comprises a passive driver and a audio chip;

the passive driver is disposed in the cavity where the active driver is located, the passive driver has a vibrating diaphragm, and the passive driver and the active driver radiate together;

wherein, after the passive driver is additionally provided in the miniature loudspeaker module, an amplitude characteristics of a vibrating diaphragm of the active driver shows a local dip frequency on frequency bands below a resonant frequency point F0 which is a low frequency resonance point of the miniature loudspeaker module additionally provided with the passive driver, and the lowest point of the local dip frequency is corresponding to a frequency point Fb; and the audio chip is configured to performing, according to the amplitude characteristics of the vibrating diaphragm of the active driver of the miniature loudspeaker module additionally provided with the passive driver, matching enhancement to an input audio signal of the active driver; comprises:

filter out the input audio signal below a first frequency point which is a frequency point below the Fb, to filter out signals having an amplitude beyond an allowable range of the vibrating diaphragm of the active driver on frequency bands below the Fb;

perform band-pass filtering and enhancement to the input audio signal within a certain frequency band taking the Fb as a central frequency point, to realize low-frequency descending and bass enhancement;

perform notch filtering to the input audio signal within a certain frequency band taking the F0 as a central frequency point, to avoid too large amplitude of the vibrating diaphragm of the active driver near the F0; and perform high-pass filtering and enhancement to the input audio signal above a second frequency point higher than the F0, and enhancing mid and high frequency response by using the characteristic of small amplitude of the vibrating diaphragm of the active driver on mid and high frequency bands.

5. The miniature loudspeaker module according to claim 4, wherein, the miniature loudspeaker module is of a front porting design, and the passive driver and the active driver share a front cavity, and sound outlets are provided at positions directly facing the passive driver and the active driver in the cavity;

or, the miniature loudspeaker module is of a front porting design, and the passive driver and the active driver share a front cavity, and a common sound outlet is provided at a position directly facing the passive driver and the active driver in the cavity;

or, the miniature loudspeaker module is of a side porting design, and the passive driver and the active driver share a front cavity.

6. The miniature loudspeaker module according to claim 4, wherein, the Fb is adjusted by changing the coefficient of stiffness of the passive driver; and/or, the F0 is adjusted by changing the property of the vibrating diaphragm and the quality of voice coil of the active driver; and according to the values of the Fb and the F0 and the characteristics of both a power amplifier of the system and the amplitude of the vibrating diaphragm, one or more of the following parameters of a filter is adjusted during the matching enhancement: Q value, order, frequency band attenuation parameter and cutoff frequency.

7. An electronic device, wherein the electronic device comprises the miniature loudspeaker module according to claim 4.

8. The electronic device according to claim 7, wherein the electronic device is a mobile phone, a tablet computer, a tablet television set or a notebook computer.

* * * * *